US008613313B2

(12) United States Patent
Ziauddin et al.

(10) Patent No.: US 8,613,313 B2
(45) Date of Patent: Dec. 24, 2013

(54) SYSTEM AND METHOD FOR RESERVOIR CHARACTERIZATION

(75) Inventors: Murtaza Ziauddin, Katy, TX (US); George A. Brown, Beaconsfield (GB); Douglas Pipchuk, Calgary (CA); Waqar Khan, Lahore (PK)

(73) Assignee: Schlumberger Technology Corporation, Sugar Land, TX (US)

( * ) Notice: Subject to any disclaimer, the term of this patent is extended or adjusted under 35 U.S.C. 154(b) by 304 days.

(21) Appl. No.: 12/838,945

(22) Filed: Jul. 19, 2010

(65) Prior Publication Data

US 2012/0012308 A1 Jan. 19, 2012

(51) Int. Cl.
*E21B 47/06* (2012.01)

(52) U.S. Cl.
USPC ..... 166/250.01; 166/305.1; 73/152.12

(58) Field of Classification Search
USPC ..... 166/305.1, 250.01; 73/152.12
See application file for complete search history.

(56) References Cited

U.S. PATENT DOCUMENTS

| | | | | |
|---|---|---|---|---|
| 556,669 | A | 3/1896 | Frasch | |
| RE27,459 | E | 8/1972 | Guinn et al. | |
| 4,324,669 | A | 4/1982 | Norman et al. | |
| 4,695,389 | A | 9/1987 | Kubala | |
| 5,054,935 | A | 10/1991 | Tanabe et al. | |
| 5,343,949 | A | 9/1994 | Ross et al. | |
| 5,473,939 | A | 12/1995 | Leder et al. | |
| 5,509,474 | A | 4/1996 | Cooke, Jr. | |
| 5,609,204 | A | 3/1997 | Rebardi et al. | |
| 6,021,377 | A | 2/2000 | Dubinsky et al. | |
| 6,176,323 | B1 * | 1/2001 | Weirich et al. | 175/40 |
| 6,233,524 | B1 | 5/2001 | Harrell et al. | |
| 6,271,766 | B1 | 8/2001 | Didden et al. | |
| 6,281,489 | B1 | 8/2001 | Tubel et al. | |
| 6,399,546 | B1 | 6/2002 | Chang et al. | |
| 6,532,839 | B1 | 3/2003 | Kluth et al. | |
| 6,588,266 | B2 * | 7/2003 | Tubel et al. | 73/152.39 |
| 6,644,402 | B1 | 11/2003 | Sharma et al. | |
| 6,789,621 | B2 | 9/2004 | Wetzel et al. | |
| 7,055,604 | B2 | 6/2006 | Jee et al. | |
| 7,398,680 | B2 | 7/2008 | Glasbergen et al. | |
| 7,730,774 | B2 | 6/2010 | Glasbergen et al. | |

(Continued)

OTHER PUBLICATIONS

Permament Fiber Opic Monitoring at Northstar: Pressure/Temperature System and Data Overview—Tor K. Kragas, Bill F. Turnbull and Michael J. Francis. SPE 76747.

(Continued)

*Primary Examiner* — Giovanna Wright
(74) *Attorney, Agent, or Firm* — Michael Flynn

(57) ABSTRACT

A method for determining flow distribution in a formation having a wellbore formed therein includes the steps of positioning a sensor within the wellbore, wherein the sensor generates a feedback signal representing at least one of a temperature and a pressure measured by the sensor, injecting a fluid into the wellbore and into at least a portion of the formation adjacent the sensor, shutting-in the wellbore for a pre-determined shut-in period, generating a simulated model representing at least one of simulated temperature characteristics and simulated pressure characteristics of the formation during the shut-in period, generating a data model representing at least one of actual temperature characteristics and actual pressure characteristics of the formation during the shut-in period, wherein the data model is derived from the feedback signal, comparing the data model to the simulated model, and adjusting parameters of the simulated model to substantially match the data model.

19 Claims, 2 Drawing Sheets

(56) References Cited

U.S. PATENT DOCUMENTS

| | | | | |
|---|---|---|---|---|
| 7,779,638 | B2 | 8/2010 | Sauciuc et al. | |
| 2001/0020675 | A1 | 9/2001 | Tubel et al. | |
| 2002/0023752 | A1 | 2/2002 | Qu et al. | |
| 2004/0040707 | A1 | 3/2004 | Dusterhoft et al. | |
| 2007/0143023 | A1 | 6/2007 | Betancourt et al. | |
| 2007/0234788 | A1 * | 10/2007 | Glasbergen et al. | 73/152.12 |
| 2008/0083273 | A1 | 4/2008 | Sroka et al. | |
| 2009/0091320 | A1 | 4/2009 | Flaum et al. | |
| 2009/0272580 | A1 * | 11/2009 | Dolman et al. | 175/48 |

OTHER PUBLICATIONS

The Use of Fibe-Optic Distributed Temperature Sensing and Remote Hydraulically Operated Interval Control Valves for Management of Water Production in the Douglas Field—Michael Tola, Maurice Boyle and Glynn Williams. SPE 71676.

Evaluation of Oil Soluble Resin Mixtures as Diverting Agents for Matrix Acidizing, C.W. Crowe. SPE 3505.

A New Effective Matrix Stimulation Diversion Technique, Giovanni Paccaloni. SPE 24781.

Tracing Fluid Movements with a New Temperature Technique. Earl Johns. SPE 1750.

Foam as a Diverting Technique for Matrix Sandstone Stimulation, J.W. Burman and B.E. Hall. SPE 15575.

Case Study of a Novel Acid-Diversion Technique in Carbonate Reservoirs, F.F. Chang, T. Love, J.B. Blevins III, R.L, Thomas and D.K. Fu. SPE 56529.

International Search Report and Written Opinion for International Application No. PCT/US2011/044561 dated Mar. 16, 2012.

Temperature Logging by the Distributed Temperature Sensing Technique during Injection Tests by Sakaguchi et al. May 28-Jun. 10, 2000.

Permament Fiber Opic Monitoring at Northstar: Pressure/Temperature System and Data Overview—Tor K. Kragas, Bill F. Turnbull and Michael J. Francis. SPE 76747, Copyright 2002.

The Use of Fibe-Optic Distributed Temperature Sensing and Remote Hydraulically Operated Interval Control Valves for Management of Water Production in the Douglas Field—Michael Tola, Maurice Boyle and Glynn Williams. SPE 71676, Copyright 2001.

Evaluation of Oil Soluble Resin Mixtures as Diverting Agents for Matrix Acidizing, C.W. Crowe. SPE 3505, Copyright 1971.

A New Effective Matrix Stimulation Diversion Technique, Giovanni Paccaloni. SPE 24781, Aug. 1995.

Some Applications of Differential Temperature Logging—Lonnie R. Jameson. SPE 1977.

Tracing Fluid Movements with a New Temperature Technique. Earl Johns. SPE 1750, Copyright 1967.

Foam as a Diverting Technique for Matrix Sandstone Stimulation, J.W. Burman and B.E. Hall. SPE 15575, Copyright 198.5.

Case Study of a Novel Acid-Diversion Technique in Carbonate Reservoirs, F.F. Chang, T. Love, J.B. Blevins Ill, R. L, Thomas and D.K. Fu. SPE 56529, Copyright 1999.

Sierra, et al. DTS Monitoring Data of Hydraulic Fracturing: Experiences and Lessons Learned, Copyright 2008, Denver Colorado, USA, Sep. 21-24, 2008. SPE 116182.

Tardy, et al., "An Experimentally Validated Wormhole Model for Self-Diverting and Conventional Acids in Carbonate Rocks Under Radial Flow Conditions", SPE 107854—European Formation Damage Conference, Scheveningen, The Netherlands, 2007.

* cited by examiner

SYSTEM AND METHOD FOR RESERVOIR CHARACTERIZATION

BACKGROUND

The statements in this section merely provide background information related to the present disclosure and may not constitute prior art.

The present disclosure relates generally to wellbore treatment and development of a reservoir and, in particular, to a system and a method for determining characteristics of the reservoir during a wellbore operation such as, but not limited to, a wellbore treatment operation, an underbalanced drilling operation, or the like.

Currently, fiber optic Distributed Temperature Sensing (DTS) technology provides a means for substantially instantaneous temperature measurement in a wellbore. DTS typically includes an optical fiber disposed in the wellbore (e.g. via a permanent fiber optic line cemented in the casing, a fiber optic line deployed using a coiled tubing, or a slickline unit). The optical fiber measures a temperature distribution along a length thereof based on an optical time-domain (e.g. optical time-domain reflectometry (OTDR), which is used extensively in the telecommunication industry).

One advantage of DTS technology is the ability to acquire in a short time interval the temperature distribution along the well without having to move the sensor as in traditional well logging which can be time consuming. DTS technology effectively provides a "snap shot" of the temperature profile in the well. DTS technology has been utilized to measure temperature changes in a wellbore after a stimulation injection, from which a flow distribution of an injected fluid can be qualitatively estimated.

The introduction of hot slugs in a wellbore is another useful technique for flow profiling with Distributed Temperature Sensing (DTS). The conventional method of generating a hot slug includes injecting a large fluid volume in the reservoir and then shutting the well in to heat the fluids above the reservoir interval. The temperature of the fluids next to the reservoir interval increase much slower as the reservoir interval is much cooler because of fluids injected previously. This differential heating creates a temperature front that can be tracked with DTS for flow profiling.

By obtaining and analyzing multiple DTS temperature traces, the characteristics and flow properties of different formation layers can be determined.

Several methods for quantitatively characterizing a reservoir and determining the flow distribution therein from a DTS measurement are discussed in detail below.

SUMMARY

An embodiment of a method for determining characteristics of a formation having a wellbore formed therein comprises the steps of: positioning a sensor within the wellbore, wherein the sensor generates a feedback signal representing a temperature therein; injecting a fluid into the wellbore; generating a data model representing temperature characteristics of the formation, wherein the data model is derived from the feedback signal; and analyzing the data model based upon an instruction set to extrapolate characteristics of the formation.

In another embodiment, a method for determining characteristics of a formation having a wellbore formed therein comprises the steps of: positioning a sensor within the wellbore, wherein the sensor provides a substantially continuous temperature monitoring along a pre-determined interval of the wellbore, and wherein the sensor generates a feedback signal representing temperature measured by the sensor; injecting a first fluid into the wellbore and into at least a portion of the formation adjacent to the interval; generating a data model representing actual thermal characteristics of at least a sub-section of the interval, wherein the data model is derived from the feedback signal; and analyzing the data model based upon an instruction set to extrapolate characteristics of the formation.

In yet another embodiment, a method for determining characteristics of a formation having a wellbore formed therein comprises the steps of:

a) positioning a distributed temperature sensor within the wellbore, wherein the sensor provides a substantially continuous temperature monitoring along a pre-determined interval of the wellbore, and wherein the sensor generates a feedback signal representing temperature measured by the sensor;
b) deploying a coiled tubing into the wellbore;
c) injecting a first fluid through the coiled tubing and into the wellbore;
d) generating a data model representing thermal characteristics of at least a sub-section of the interval, wherein the data model is derived from the feedback signal;
e) analyzing the data model based upon an instruction set to extrapolate characteristics of the formation; and
f) repeating steps c) through e) for each of a plurality of sub-sections defining the interval within the wellbore to generate a profile representative of the entire interval.

BRIEF DESCRIPTION OF THE DRAWINGS

These and other features and advantages of the present invention will be better understood by reference to the following detailed description when considered in conjunction with the accompanying drawings wherein.

DETAILED DESCRIPTION

Figure 1:
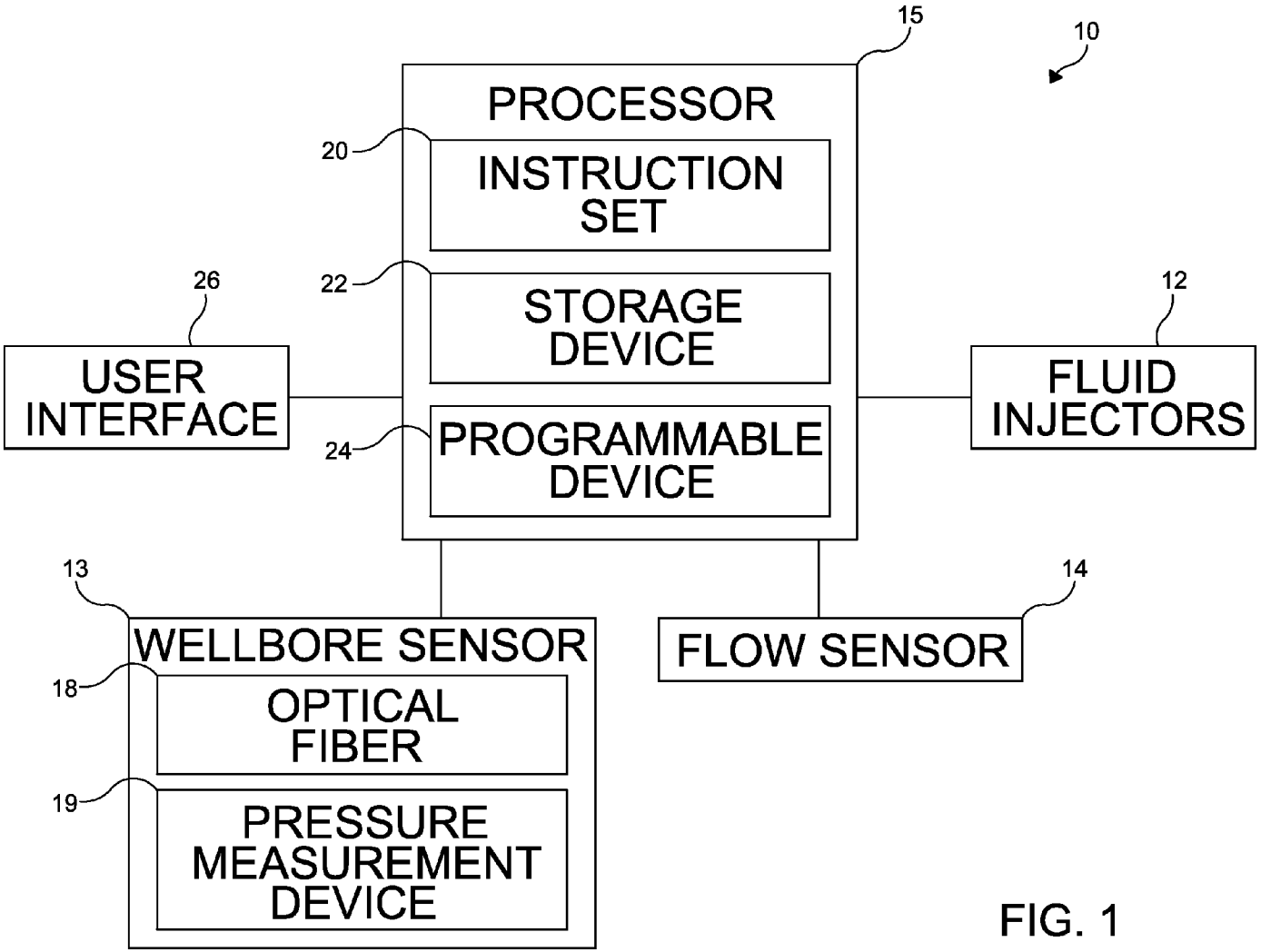
FIG. 1 is a schematic block diagram of an embodiment of a wellbore treatment system.
Figure 2:
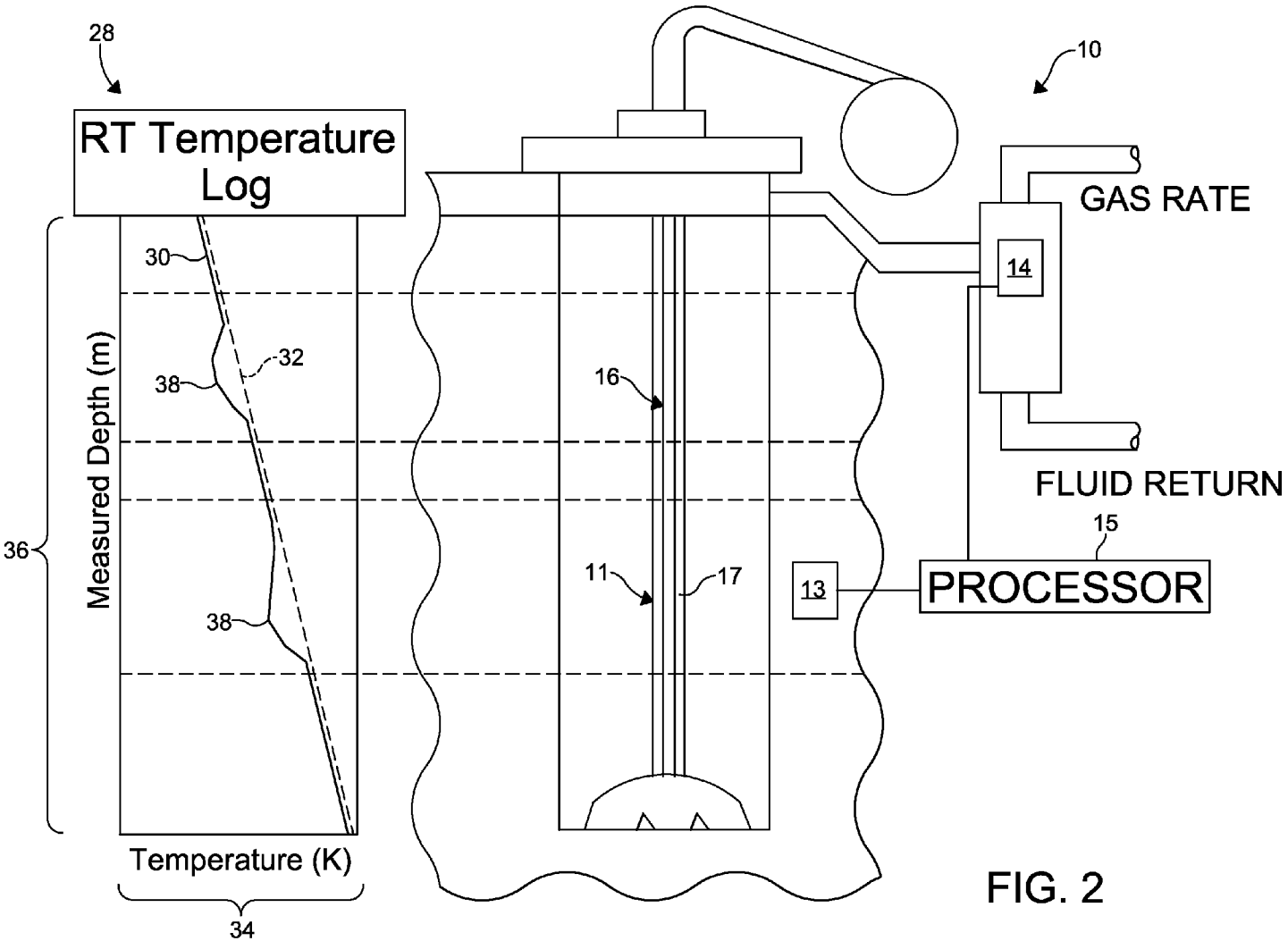
FIG. 2 is a schematic representation of the wellbore treatment system of FIG. 2, showing a graphical plot of an associated temperature log measured by the system.

Referring now to FIGS. 1-2, there is shown an embodiment of a reservoir characterization system, indicated generally at 10. As shown, the system 10 includes a fluid injector(s) 12, a wellbore sensor 13 disposed adjacent a wellbore 11, a flow sensor 14, and a processor 15. It is understood that the system 10 may include additional components.

The fluid injector 12 typically includes a coiled tubing 16, which can be positioned in a wellbore, such as the wellbore 11, formed in a formation to selectively direct a fluid to a particular depth or layer of the formation. For example, the fluid injector 12 can direct a diverter immediately adjacent a layer of the formation to plug the layer and minimize a permeability of the layer. As a further example, the fluid injector 12 can direct a stimulation fluid adjacent to a layer for stimulation. It is understood that other means for directing various fluids (e.g. drilling fluids) to various depths and layers can be used, as appreciated by one skilled in the art of drilling and wellbore treatment. It is further understood that various drilling fluids, treating fluids, diverters, and stimulation fluids can be used to treat various layers of a particular formation.

In certain embodiments, a first fluid or chemical is injected into the wellbore through the coiled tubing 16 and a second fluid or chemical is injected into the wellbore via an annulus 17 formed between the wellbore 11 the coiled tubing 16. It is understood that the second chemical may be injected between a portion of the formation and an exterior housing of the coiled tubing 16 using another injection means or conduit.

The first chemical and the second chemical are selected to generate a hot slug when mixed. As a non-limiting example, the first chemical is sodium nitrate (NaNO2), the second chemical is ammonium chloride (NH4C1), and the chemical reaction for generating the hot slug for flow profiling with DTS is: NaNO2+NH4C1→NaC1+H2O+N2. The chemical reaction generates heat and a gaseous phase nitrogen (N2). As a non-limiting example, the reaction is highly exothermic (~80 kcal/mol) and the reaction rate can be controlled by the pH of the system. The delta T from the reaction can be controlled by the concentration of the reactants. It is understood that the reactants sodium nitrate (NaNO2) and ammonium chloride (NH4C1) are very soluble in water. It is further understood that a surfactant may be added to the fluids/chemicals to foam-up and trap the gaseous N2 to insulate the fluids/chemicals and therefore allow monitoring for extended time.

Exothermic reactions may be expressed in the general form as:

A+B+ . . . - - - (Catalyst/retarder C)->D+E+ . . . Heat

For the reaction to occur, all reactants (i.e. A and B in the above example) need to be present. It is desirable at times to control the rate of reaction, which may be altered by the presence of a catalyst or a retarder C noted above. As noted above, an example of an exothermic reaction suitable for generating the hot slug for flow profiling with DTS is: NaNO2+NH4Cl→NaCl+H2O+N2. The reaction, in this example, is catalyzed by acid and the rate of reaction (i.e. acceleration or deceleration of the reaction), therefore, may be controlled by controlling the pH of the reaction.

The reaction may be controlled by separating the reactants and/or the catalyst/retarder and then controlling the zone of mixing of reactants for targeting the release of heat to a specific area or areas. The reaction may be controlled by separated the reactants by injecting reactants from different flow paths (such as one reactant thru the coiled tubing 16 and the other reactant through the annulus 17). The reaction may be controlled by controlling the location of the mixing zone by changing the injection rates of A and B. The reaction may be controlled by splitting the reactants into two separate fluids and injecting the two fluids sequentially, such as into the coiled tubing 16, with an optional buffer in the middle of the fluids. In such a situation, the size of the buffer dictates the time of reaction and the reaction will occur at the interface. The reaction may be controlled by encapsulating or generating in-situ one of the reactants, the catalyst, or retarder for the reaction. For those reactions in which the catalyst is required in small concentrations, it may be easier to separate the catalyst. For the above-mentioned reaction, the acid catalyst for the reaction (e.g. oxalic or citric acid) may be encapsulated in ethyl cellulose or paraffin (wax). If paraffin is used, it will melt as the fluids travel downhole and release the catalyst for the reaction. The reaction may also be controlled by coating the catalyst on the surface where the reaction is desired to take place, such as, but not limited to, on the exterior surface of the coiled tubing 16. The reaction may also be controlled by injecting the reactants as a pre or post flush of a treatment, wherein the reaction and, therefore, the hot slug will be formed during flow back when the reactants mix. In a non-limiting example, NH4C1 can be injected into the coiled tubing 16 as a post flush of a stimulation treatment. The treatment fluid and post flush fluid (NH4Cl) is flowed back through the annulus 17, followed by NaNO2 (i.e., the second reactant) injected into the coiled tubing 16. Hot slugs will form near zones from the wellbore 11 which flow back NH4Cl when the NaNO2 reacts with the NH4CL, which may be used as an indicator for clean-up of a particular zone (i.e. if now NH4Cl is detected coming out of that layer, this would mean the zone has not cleaned-up, and a larger draw-down may be necessary, or the like).

The wellbore sensor 13 typically incorporates a Distributed Temperature Sensing (DTS) technology including an optical fiber 18 disposed in the wellbore (e.g. via a permanent fiber optic line cemented in the casing, a fiber optic line deployed using a coiled tubing, or a slickline unit). The optical fiber 18 measures the temperature distribution along a length thereof based on optical time-domain (e.g. optical time-domain reflectometry). In certain embodiments, the wellbore sensor 13 includes a pressure measurement device 19 for measuring a pressure distribution in the wellbore and surrounding formation. In certain embodiments, the wellbore sensor 13 is similar to the DTS technology disclosed in U.S. Pat. No. 7,055,604 B2, hereby incorporated herein by reference in its entirety. Other wellbore temperature sensors can be used to measure substantially real-time temperatures throughout the wellbore.

The flow sensor 14 is typically a flow meter for measuring at least the hydrocarbon production rate (i.e. gas rate) from the wellbore. However, it is understood that any sensor or device for measuring the gas rate of a particular wellbore can be used.

The processor 15 is in data communication with the wellbore sensor 13 to receive data signals (e.g. a feedback signal) therefrom and analyze the signals based upon a pre-determined algorithm, mathematical process, or equation, for example. As shown in FIG. 1, the processor 15 analyzes and evaluates a received data based upon an instruction set 20. The instruction set 20, which may be embodied within any computer readable medium, includes processor executable instructions for configuring the processor 15 to perform a variety of tasks and calculations. As a non-limiting example, the instruction set 20 may include a comprehensive suite of equations governing a physical phenomena of fluid flow in the formation, a fluid flow in the wellbore, a fluid/formation (e.g. rock) interaction in the case of a reactive stimulation fluid, a fluid flow in a fracture and its deformation in the case of hydraulic fracturing, and a heat transfer in the wellbore and in the formation. As a further non-limiting example, the instruction set 20 includes a comprehensive numerical model for carbonate acidizing such as described in Society of Petroleum Engineers (SPE) Paper 107854, titled "An Experimentally Validated Wormhole Model for Self-Diverting and Conventional Acids in Carbonate Rocks Under Radial Flow Conditions," and authored by P. Tardy, B. Lecerf and Y. Christanti, hereby incorporated herein by reference in its entirety. It is understood that any equations can be used to model a fluid flow and a heat transfer in the wellbore and adjacent formation, as appreciated by one skilled in the art of wellbore treatment. It is further understood that the processor 15 may execute a variety of functions such as controlling various settings of the wellbore sensor 13 and the fluid injector 12, for example.

As a non-limiting example, the processor 15 includes a storage device 22. The storage device 22 may be a single storage device or may be multiple storage devices. Furthermore, the storage device 22 may be a solid state storage system, a magnetic storage system, an optical storage system or any other suitable storage system or device. It is understood that the storage device 22 is adapted to store the instruction set 20. In certain embodiments, data retrieved from the wellbore sensor 13 is stored in the storage device 22 such as a temperature measurement and a pressure measurement, and a history of previous measurements and calculations, for example. Other data and information may be stored in the storage device 22 such as the parameters calculated by the processor 15, a database of petrophysical and mechanical properties of various formations, a database of natural fractures of a particular formation, and data tables used in reservoir characterization in various drilling operations (e.g. underbalanced drilling characterization), for example. It is further understood that certain known parameters and numerical models for various formations and fluids may be stored in the storage device 22 to be retrieved by the processor 15.

As a further non-limiting example, the processor 15 includes a programmable device or component 24. It is understood that the programmable device or component 24 may be in communication with any other component of the system 10 such as the fluid injector 12 and the wellbore sensor 13, for example. In certain embodiments, the programmable component 24 is adapted to manage and control processing functions of the processor 15. Specifically, the programmable component 24 is adapted to control the analysis of the data signals (e.g. feedback signal generated by the wellbore sensor 13) received by the processor 15. It is understood that the programmable component 24 may be adapted to store data and information in the storage device 22, and retrieve data and information from the storage device 22.

In certain embodiments, a user interface 26 is in communication, either directly or indirectly, with at least one of the fluid injector 12, the wellbore sensor 13, and the processor 15 to allow a user to selectively interact therewith. As a non-limiting example, the user interface 26 is a human-machine interface allowing a user to selectively and manually modify parameters of a computational model generated by the processor 15.

In use, the wellbore sensor 13 is disposed along an interval within the wellbore to provide substantially continuous temperature monitoring along the interval, wherein the wellbore sensor 13 generates a feedback signal representing temperature measured thereby. In certain embodiments, a data model is generated representing temperature characteristics of the formation derived from the feedback signal. The processor 15 analyzes the data model based on the instruction set 20 to extrapolate characteristics of the formation including a flow profile of the wellbore. As a non-limiting example, the processor 15 analyzes the data model (e.g. real-time temperature log) by comparing the temperature characteristics of the formation to at least one of a geothermal gradient, a flowing bottom hole pressure, and a well head pressure. As a further non-limiting example, the data model is compared to a data log of known or estimated petrophyscial characteristics (including natural fractures) of the formation at various depths. It is understood that the process can be repeated for each of a plurality of sub-sections defining the interval within the wellbore to generate a profile representative of the entire interval.

As an illustrative example, FIG. 2 includes a graphical plot 28 showing a substantially real-time temperature log 30 (i.e. data model) and a pre-defined geothermal gradient 32 for a formation having a wellbore formed therein. It is understood that the temperature log 30 is based upon data acquired by the wellbore sensor 13. As shown, the X-axis 34 of the graphical plot 28 represents temperature and the Y-axis 36 of the graphical plot 28 represents a depth of the formation, measured from a pre-determined surface level. As a non-limiting example, the processor 15 analyzes the temperature log 30 based upon the instruction set 20 to identify temperature patterns such as a localized temperature decreases (i.e. sweet spots 38) caused by gas entry into the wellbore. By analyzing the substantially real-time temperature throughout an interval of the wellbore, a more accurate characterization of the wellbore can be achieved. An accurate characterization can improve well completion decisions (especially for hydraulic fracturing) to allow for staged completions targeting points of gas influx.

In certain embodiments, the wellbore characterization system 10 is applied to an underbalanced drilling (UBD) operation. During the UBD operation the pressure in the wellbore is kept lower than the fluid pressure in the formation being drilled. As the well is being drilled, formation fluid flows into the wellbore and to the surface. It is understood that in the underbalanced drilling of tight reservoirs there is generally no water production and typically no oil/condensate. Therefore, any cooling effect observed by analyzing the temperature characteristics represented by the data model is due to gas entry into the well bore (i.e. the Joule Thompson effect related to gas expansion). Since the temperature measurement by the wellbore sensor 13 is continuous and along an interval of the wellbore, any changes in downhole pressure results in a change in temperature, which allows for estimation of reservoir permeability.

In certain embodiments, a fluid is injected into a formation (e.g. laminated rock formation) to remove or by-pass a near well damage, which may be caused by drilling mud invasion or other mechanisms, or to create a hydraulic fracture that extends hundreds of feet into the formation to enhance well flow capacity. A temperature of the injected fluid is typically lower than a temperature of each of the layers of the formation. Throughout the injection period, the colder fluid removes thermal energy from the wellbore and surrounding areas of the formation. Typically, the higher the inflow rate into the formation, the greater the injected fluid volume (i.e. its penetration depth into the formation), and the greater the cooled region. In the case of hydraulic fracturing, the injected fluid enters the created hydraulic fracture and cools the region adjacent to the fracture surface. When pumping stops, the heat conduction from the reservoir gradually warms the fluid in the wellbore. Where a portion of the formation does not receive inflow during injection will warm back faster due to a smaller cooled region, while the formation that received greater inflow warms back more slowly.

In certain embodiments, a hot slug is created in the wellbore. Specifically, the first chemical is injected from the coiled tubing 16 into the wellbore and the second chemical is injected through the annulus 17. A hot slug is created where the first chemical and the second chemical mix. The hot slug can be detected by the wellbore sensor 13. However, the hot slug can also be detected by other temperature sensors. It is understood that an operator can use the hot slug temperature spike to locate the interface between the first chemical and the second chemical (the interface location is of importance in many simulation treatments).

As a non-limiting example, the first and second chemicals for creation of the hot slug are injected together; however, the time (and hence the location) for creation of the hot slug can be controlled by the reaction rate. As a non-limiting example, the reaction is auto catalytic. As a further non-limiting example, the reaction rate can be controlled by encapsulation of one of the chemicals (such as by ethyl cellulose or paraffin (wax)). Specifically, as the reaction between the first chemical and the second chemical is initiated, an increase in temperature melts the wax. With the wax partially melted, more of the first and second chemicals are released, leading to a further increase in the reaction rate which melts the wax further, thereby releasing more of the first and second chemicals. In certain embodiments, an outside wall of the coiled tubing 16 can also be coated with one of the chemicals (e.g. NaNO2). Accordingly, a "heat-up" or temperature spike will be observed where the other reactant chemical (e.g. NH4C1) comes into contact with the chemical coated on the coiled tubing 16. Once the hot slug is generated, the well can be produced to calculate the flow profile from entry and tracking of hot slug temperate spike in the wellbore.

The system 10 and methods described herein provide a means to characterize a reservoir in various drilling operations, including underbalanced drilling. Using continuous and substantially real-time temperature tracking, in addition to other measurements (both surface and downhole), the system 10 can extrapolate reservoir properties.

The preceding description has been presented with reference to presently preferred embodiments of the invention. Persons skilled in the art and technology to which this invention pertains will appreciate that alterations and changes in the described structures and methods of operation can be practiced without meaningfully departing from the principle, and scope of this invention. Accordingly, the foregoing description should not be read as pertaining only to the precise structures described and shown in the accompanying drawings, but rather should be read as consistent with and as support for the following claims, which are to have their fullest and fairest scope.

We claim:

1. A method for determining characteristics of a formation having a wellbore formed therein, comprising:

positioning a sensor within the wellbore, wherein the sensor generates a feedback signal representing a temperature in the wellbore, wherein the sensor comprises distributed temperature sensing technology having an optical fiber disposed along an interval within the wellbore;

injecting a fluid into the formation via the wellbore;

generating a data model representing real-time temperature characteristics of the formation, wherein the data model is derived from the feedback signal resulting from the injected fluid; and analyzing the data model based upon an instruction set to extrapolate characteristics of the formation by comparing the data model to at least a pre-defined thermal characteristic of the formation, wherein the instruction set comprises at least one pre-determined algorithm, mathematical process, or equation.

2. The method according to claim 1 further comprising the step of performing an underbalanced drilling operation in the wellbore.

3. The method according to claim 1 further comprising the step of monitoring a production rate of hydrocarbon flowing from the wellbore, wherein the instruction set includes a comparison of the production rate and the temperature characteristics.

4. The method according to claim 1 further comprising the step of monitoring a pressure in the wellbore, wherein the instruction set includes a comparison of the pressure in the wellbore and the temperature characteristics.

5. The method according to claim 1 wherein the fluid is at least one of a diverting agent, a stimulation fluid, and a drilling fluid.

6. The method according to claim 1 wherein the instruction set includes a log of at least one of a natural fracture in the formation and petrophysical properties of the formation.

7. The method of claim 1 wherein positioning comprises positioning a sensor within the wellbore by deploying a coiled tubing into the wellbore.

8. A method for determining characteristics of a formation having a wellbore formed therein, comprising:

positioning a sensor within the wellbore, wherein the sensor provides a substantially continuous temperature monitoring along a pre-determined interval of the wellbore, wherein the sensor includes distributed temperature sensing technology having an optical fiber disposed along the pre-determined interval within the wellbore, and wherein the sensor generates a feedback signal representing temperature measured by the sensor;

injecting a first fluid into the wellbore and into at least a portion of the formation adjacent the interval;

generating a data model representing actual substantially real-time thermal characteristics of at least a sub-section of the interval, wherein the data model is derived from the feedback signal resulting from the injected first fluid; and analyzing the data model based upon an instruction set to identify temperature patterns in the formation and comparing the generated data model to at least one predefined thermal characteristic of the formation to thereby extrapolate characteristics of the formation.

9. The method according to claim 8 further comprising the step of performing an underbalanced drilling operation in the wellbore.

10. The method according to claim 8 further comprising the step of monitoring a production rate of hydrocarbon flowing from the wellbore, wherein the instruction set includes a comparison of the production rate and the temperature characteristics.

11. The method according to claim 8 further comprising the step of monitoring a pressure of in the wellbore, wherein the instruction set includes a comparison of the pressure in the wellbore and the temperature characteristics.

12. The method according to claim 8 wherein the instruction set includes a log of at least one of a natural fracture in the formation and petrophysical properties of the formation.

13. The method according to claim 8 further comprising the step of injecting a second fluid into the wellbore to generate a hot slug, wherein the first fluid includes a first reactant and the second fluid includes a second reactant, and wherein a reaction rate between the first and second reactants is controlled.

14. The method according to claim 13 wherein the first fluid is injected through a coiled tubing disposed in the wellbore.

15. The method according to claim 13 wherein the second fluid is injected through an annulus of a coiled tubing disposed in the wellbore.

16. A method for determining characteristics of a formation having a wellbore formed therein, comprising:

a) positioning a distributed temperature sensor within the wellbore by deploying a coiled tubing into the wellbore, wherein the sensor provides a substantially continuous temperature monitoring along a pre-determined interval of the wellbore, wherein the sensor includes distributed temperature sensing technology having an optical fiber disposed along an interval within the wellbore, and wherein the sensor generates a feedback signal representing temperature measured by the sensor;

b) injecting a first fluid through the coiled tubing and into the formation;

c) generating a data model representing thermal characteristics of at least a sub-section of the interval, wherein the data model is derived from the feedback signal resulting from the injected first fluid;

d) analyzing the data model based upon an instruction set to extrapolate characteristics of the formation by comparing the data model to at least a pre-defined thermal characteristic of the formation; and repeating steps b) through d) for each of a plurality of sub-sections defining the interval within the wellbore to achieve an improved characterization of the entire interval.

17. The method according to claim 16 further comprising the step of injecting a second fluid into the wellbore to generate a hot slug.

18. The method according to claim 17 wherein the first fluid includes a first reactant and the second fluid includes a second reactant.

19. The method of claim 16 wherein the improved characterization is utilized to improve subsequent well completion decisions.

* * * * *